US006433750B1

(12) United States Patent
Sugita

(10) Patent No.: US 6,433,750 B1
(45) Date of Patent: Aug. 13, 2002

(54) RECEPTION ANTENNA FOR RADIO WAVE MARKER

(75) Inventor: Hideki Sugita, Tokyo (JP)

(73) Assignee: Mitsubishi Denki Kabushiki Kaishi, Tokyo (JP)

( * ) Notice: Subject to any disclaimer, the term of this patent is extended or adjusted under 35 U.S.C. 154(b) by 0 days.

(21) Appl. No.: 09/931,582

(22) Filed: Aug. 17, 2001

(30) Foreign Application Priority Data

Mar. 28, 2001 (JP) ..... 2001-093177

(51) Int. Cl.[7] ..... H01Q 1/32
(52) U.S. Cl. ..... 343/713; 343/789
(58) Field of Search ..... 343/711, 712, 343/713, 714, 725, 716, 707, 789; 340/905, 933, 939

(56) References Cited

U.S. PATENT DOCUMENTS 4,373,161 A * 2/1983 Matsumura ..... 343/717
4,806,943 A * 2/1989 Doncel ..... 343/742
4,968,984 A * 11/1990 Katoh et al. ..... 343/713
5,453,754 A * 9/1995 Fray ..... 343/789
6,097,312 A * 8/2000 Tanji et al. ..... 340/905

FOREIGN PATENT DOCUMENTS

| | | |
|---|---|---|
| JP | 7-30325 | 1/1995 |
| JP | 10-152029 | 6/1998 |
| JP | 10-198887 | 7/1998 |

* cited by examiner

*Primary Examiner*—Tho Phan
*Assistant Examiner*—James Clinger

(57) ABSTRACT

Disclosed is a radio wave marker reception antenna which is not easily affected by disturbance noises, such as a broadcast wave, which are set to the same frequency band as the radio wave signal conveying driving assisting information. The radio wave marker reception antenna is equipped with a cover which is formed of a conductive material and which has a prism-like, cylindrical, conical, dome-shaped, or forwardly broadening configuration. The cover may be installed such that it is inclined from the position where its lower side is oriented vertically downward to a position where its lower side is directed obliquely forward. Further, the interior of the cover may be filled with a non-conductive material.

8 Claims, 6 Drawing Sheets

RECEPTION ANTENNA FOR RADIO WAVE MARKER

BACKGROUND OF THE INVENTION

1. Field of the Invention

This invention relates to a reception antenna for a radio wave marker and, more specifically, to a reception antenna for a radio wave marker which, when installed in a condition in which it is affected by disturbance noises, can reduce the influence of the disturbance noises and receive a radio wave signal from a road-side radio wave marker transmission antenna in a stable manner.

2. Description of the Related Art

FIGS. 9, 10, and 11 are schematic diagrams showing a vehicle driving assisting system utilizing a conventional radio wave marker system. In the drawings, numeral 1 indicates a road, numeral 2 indicates a road-side radio wave marker transmission antenna installed under the surface of the road 1, numeral 3 indicates a vehicle running on the road 1, numeral 4 indicates an engine constituting the motive power source of the vehicle, numeral 5 indicates a bumper, numeral 6 indicates a radio wave marker reception antenna mounted on the vehicle 3, and numeral 7 indicates a cable connected to the radio wave marker reception antenna 6.

Next, the operation of the above system will be described with reference to FIGS. 9 and 11. When, as shown in FIG. 9, the vehicle 3 running on the road 1 approaches the road-side radio wave marker transmission antenna 2, various kinds of driving assisting information necessary for the driving of the vehicle are supplied from the road-side radio wave marker transmission antenna 2. When passing over the road-side radio wave marker transmission antenna 2, the vehicle 3 receives the driving assisting information by means of the radio wave marker reception antenna 6. As shown in FIG. 11, the driving assisting information received is transmitted from the radio wave marker reception antenna 6 to a vehicle-mounted control unit through the cable 7, and the vehicle is controlled on the basis of the driving assisting information.

When mounting the radio wave marker reception antenna 6 in the front portion of the vehicle 3, the mounting of the reception antenna is effected at a position where it is invisible from outside, for example, at a position between the bumper 5 and the engine 4, as shown in FIG. 10, so as not to impair the outward appearance of the vehicle.

The radio wave marker reception antenna 6 in the conventional radio wave marker system, constructed as described above, has a problem in that it receives not only the radio wave signal conveying the driving assisting information from the road-side radio wave marker transmission antenna 2, but also a radio wave such as a broadcast wave set to the same frequency band as the radio wave signal. Further, it receives disturbance noises, such as an ignition system noise emanated from the vehicle engine 4 and a vehicle-mounted apparatus noise generated from an electronic apparatus like a PC mounted in the vehicle. As a result, the reception of the desired radio wave signal from the road-side radio wave marker transmission antenna 2 is hindered.

SUMMARY OF THE INVENTION

This invention has been made with a view toward solving the above problem in the prior art. It is accordingly an object of this invention to provide a radio wave marker reception antenna which is not easily affected by the disturbance noises as mentioned above.

In accordance with this invention, there is provided a radio wave marker reception antenna mounted in a mobile body and adapted to receive driving assisting information from a road-side radio wave marker transmission antenna installed under the surface of a road, wherein the radio wave marker reception antenna is formed of a conductive material and equipped with a cover whose lower side is open.

The cover may have a prism-like configuration.

The cover may have a cylindrical configuration.

The cover may have a conical configuration.

The cover may have a dome-shaped configuration.

Further, the cover may downwardly broaden in a fixed direction, and may be mounted in the mobile body such that the broadening direction is the direction of travel.

Further, the cover may be mounted in the mobile body such that it is inclined from the position where its lower side is directed vertically downward to a position where its lower side is directed toward the direction of travel.

Further, the interior of the cover may be filled with a non-conductive material.

DESCRIPTION OF THE PREFERRED EMBODIMENTS

Embodiment 1

Figure 1:
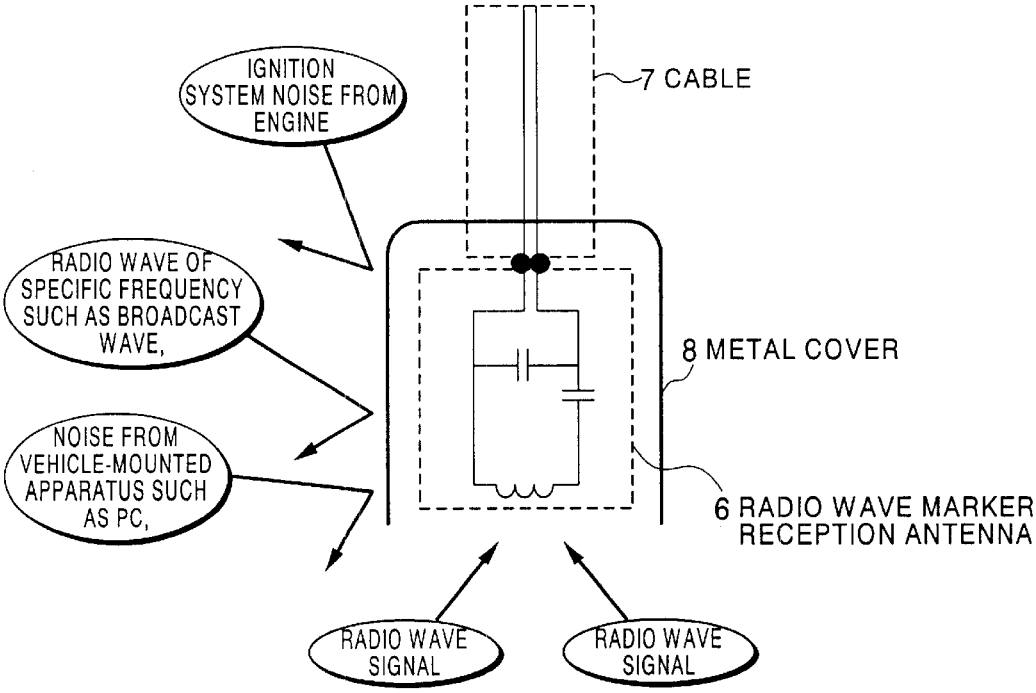
FIG. 1 is a schematic exterior view of a radio wave marker reception antenna according to Embodiment 1 of the present invention.

FIG. 1 is a schematic exterior view showing a radio wave marker reception antenna according to Embodiment 1 of this invention in FIG. 1, numeral 8 indicates a metal cover.

As shown in FIG. 1, the radio wave marker reception antenna 6 is surrounded by the metal cover 8, whereby it is possible to prevent the ignition system noise and the vehicle-mounted apparatus noise from reaching the radio wave marker reception antenna 6; similarly, it is also possible to prevent a radio wave of a specific frequency band, such as a broadcast wave, from reaching the radio wave marker reception antenna 6.

The ignition system noise emanated from the vehicle engine 4 is of a very high noise level. Further, since this ignition system noise is a pulse noise, it has a considerably wide frequency band, which may overlap the reception band of the radio wave marker reception antenna 6. Due to these factors, it can happen that the reception of the radio wave signal from the road-side radio wave marker transmission antenna 2 is hindered.

Further, in many cases, like the engine ignition system noise mentioned above, the noise generated from a vehicle-mounted electronic apparatus, such as a PC or an inverter, is a very intense pulse noise, so that it may prevent the reception of the radio wave signal from the road-side radio wave marker transmission antenna 2.

Furthermore, a broadcast wave, a radio wave and the like using the same frequency band as the radio wave signal from the road-side radio wave marker transmission antenna 2 can be received by the radio wave marker reception antenna 6, which means such radio waves can hinder the normal radio wave signal reception.

To cope with the problems mentioned above, the radio wave marker reception antenna 6 is surrounded by the metal cover 8 as shown in FIG. 1. Due to this construction, the disturbance noises, such as-the ignition system noise; the vehicle-mounted apparatus noise, and the noise of a radio wave of a specific frequency band, coming from the front, the rear, the right-hand, and the left-hand sides, and from above, are reflected/absorbed by the metal cover 8, so that it is possible to reduce the influence of these noises. On the lower side of the metal cover 8, an opening is provided, so that the radio wave signal from the road-side radio wave marker transmission antenna 2 can be received by the radio wave marker reception antenna 6 without being intercepted by the metal cover 8.

The metal cover 8 is installed so as to be spaced apart from the radio wave marker reception antenna 6 to a degree that its mounting does not cause a deterioration in the antenna characteristics of the radio wave marker reception antenna 6.

While in Embodiment 1 the metal cover 8 is used, this should not be construed restrictively. Any type of cover will do as long as it is formed of a conductive material.

Embodiment 2

Figure 2:
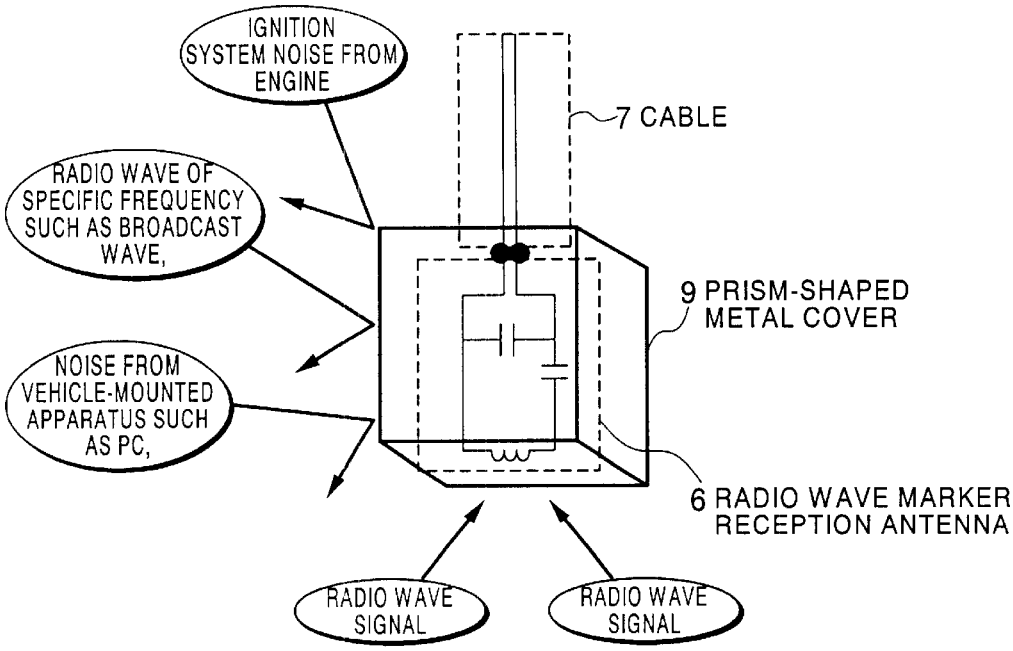
FIG. 2 is a schematic exterior view of a radio wave marker reception antenna according to Embodiment 2 of the present invention.

FIG. 2 is a schematic exterior view of a radio wave marker reception antenna according to Embodiment 2 of this invention, which differs from that of Embodiment 1. In FIG. 2, numeral 9 indicates a prism-shaped metal cover.

In Embodiment 2, the prism-shaped metal cover 9 is used, so that the metal cover can be produced easily at low cost. Further, the adoption of the prism-shaped metal cover is advantageous in that it facilitates the mounting of the radio wave marker reception antenna 6 to a planar portion.

While in Embodiment 2 the metal cover 9 is used, this should not be construed restrictively. Any type of cover will do as long as it is formed of a conductive material.

Embodiment 3

Figure 3:
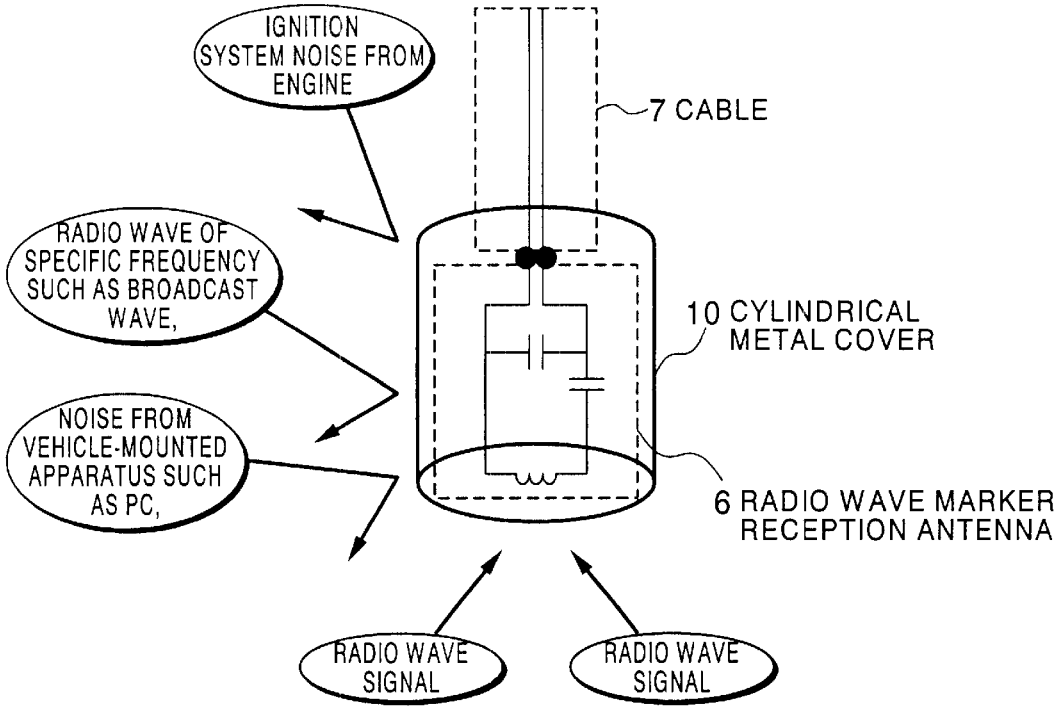
FIG. 3 is a schematic exterior view of a radio wave marker reception antenna according to Embodiment 3 of the present invention.

FIG. 3 is a schematic exterior view of a radio wave marker reception antenna according to Embodiment 3 of this invention, which differs from those of Embodiments 1 and 2. In FIG. 3, numeral 10 indicates a cylindrical metal cover.

In Embodiment 3, the cylindrical metal cover 10 is employed, so that the metal cover can be produced easily. Further, unlike the cover of Embodiment 2, it has no edge portion, which further contributes to space saving.

While in Embodiment 3 the metal cover 10 is used, this should not be construed restrictively. Any type of cover will do as long as it is formed of a conductive material.

Embodiment 4

Figure 4:
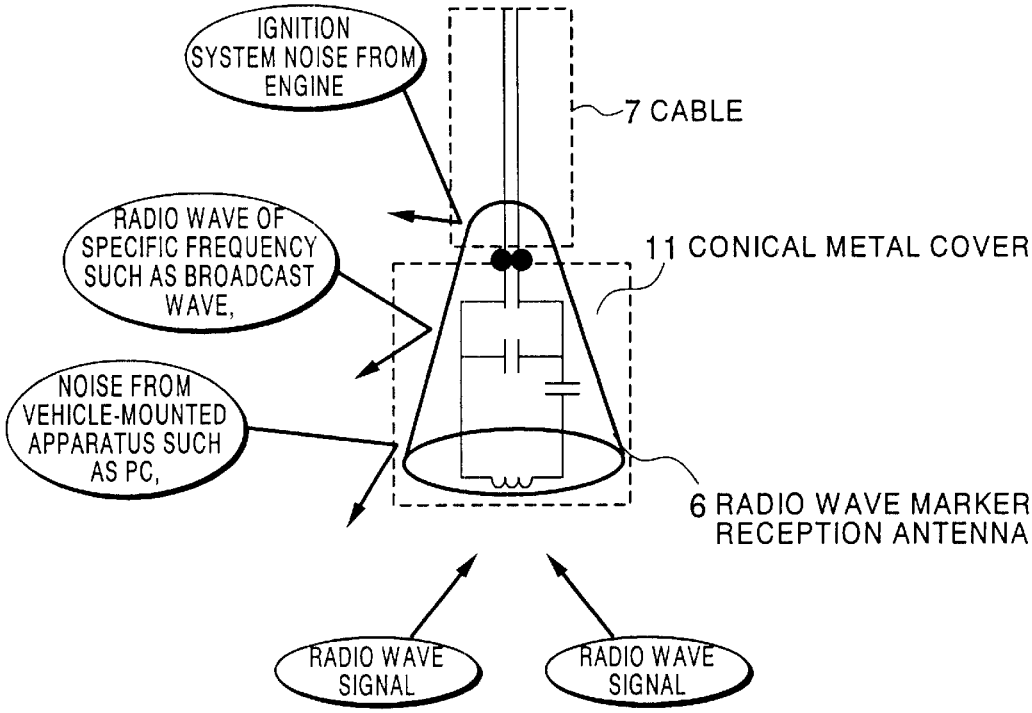
FIG. 4 is a schematic exterior view of a radio wave marker reception antenna according to Embodiment 4 of the present invention.

FIG. 4 is a schematic exterior view of a radio wave marker reception antenna according to Embodiment 4 of this invention, which differs from those of Embodiments 1 through 3. In FIG. 4, numeral 11 indicates a conical metal cover.

In Embodiment 4, the metal cover 11 broadens toward the bottom, whereby it is possible to prevent the antenna characteristics of the radio wave marker reception antenna 6 from being adversely affected. Thus, in the construction of Embodiment 4, not only is it possible to reduce the reception hindrance due to disturbance noises by means of the metal cover 11, but it is also possible to receive the radio wave signal from the road-side radio wave marker transmission antenna 2 without involving a deterioration in the antenna characteristics of the radio wave marker reception antenna 6 as a result of the attachment of the metal cover 11.

While in Embodiment 4 the metal cover 11 is used, this should not be construed restrictively. Any type of cover will do as long as it is formed of a conductive material.

Embodiment 5

Figure 5:
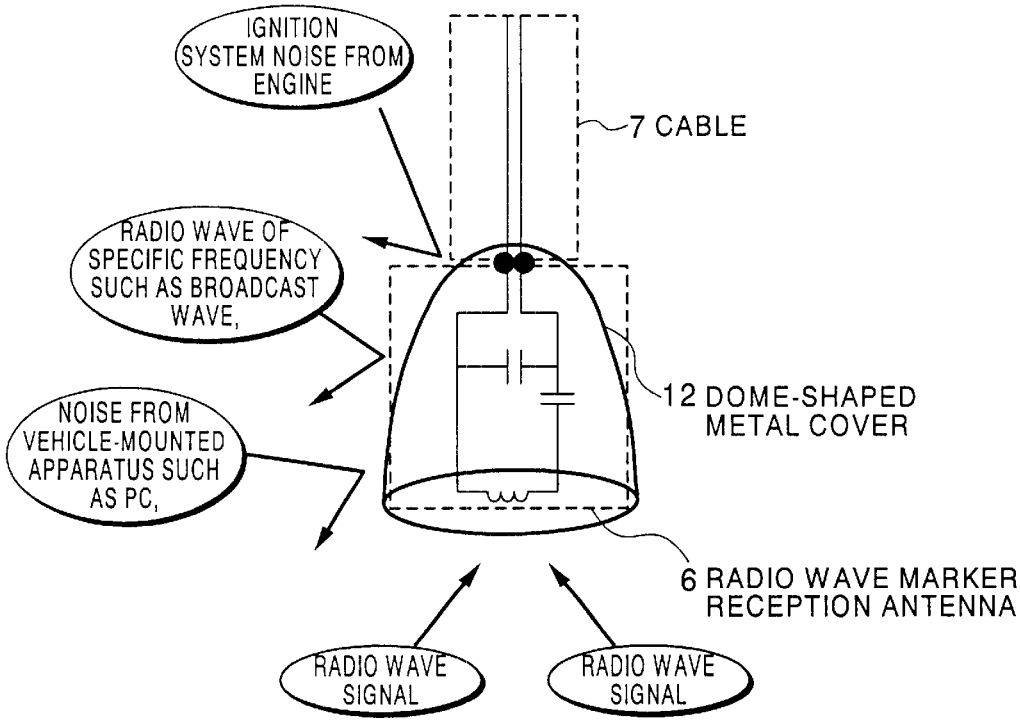
FIG. 5 is a schematic exterior view of a radio wave marker reception antenna according to Embodiment 5 of the present invention.

FIG. 5 is a schematic exterior view of a radio wave marker reception antenna according to Embodiment 5 of this invention, which differs from those of Embodiments 1 through 4. In FIG. 5, numeral 12 indicates a dome-shaped metal cover.

In Embodiment 5, the external curved surface of the metal cover 12 is dome-shaped so as to be, for example, parabolic, whereby it is possible to concentrate the radio wave signal from the road-side radio wave marker transmission antenna 2 on a focus. Thus, by positioning the radio wave marker reception antenna 6 at this focus, it is possible to achieve a further improvement in terms of reception sensitivity as compared with Embodiments 1 through 4.

While in Embodiment 5 the metal cover 12 is used, this should not be construed restrictively. Any type of cover will do as long as it is formed of a conductive material.

Embodiment 6

Figure 6:
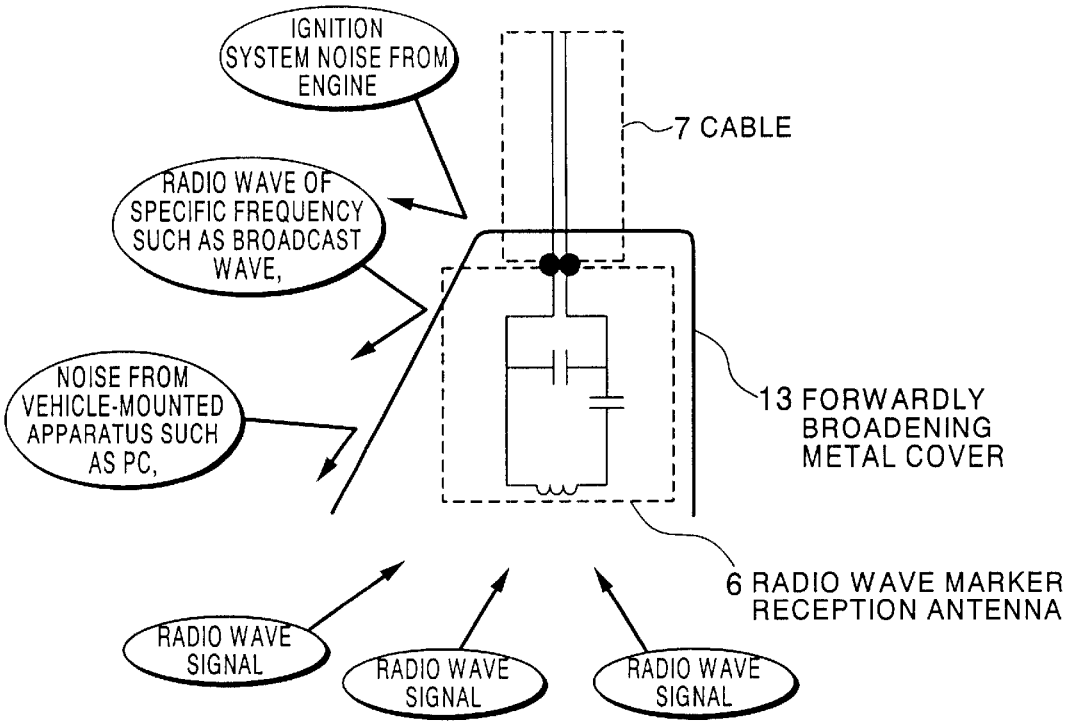
FIG. 6 is a schematic exterior view of a radio wave marker reception antenna according to Embodiment 6 of the present invention.

FIG. 6 is a schematic exterior view of a radio wave marker reception antenna according to Embodiment 6 of this invention, which differs from those of Embodiments 1 through 5. In FIG. 6, numeral 13 indicates a metal cover which downwardly broadens in a fixed direction.

In Embodiment 6, the metal cover 13 downwardly broadens in a fixed direction, whereby it is possible to catch the radio wave signal even before the vehicle reaches the position directly above the road-side marker transmission antenna 2, thereby making it possible to achieve an improvement in detection performance as compared with Embodiments 1 through 5.

Thus, in the construction of Embodiment 6, even when the vehicle 3 passes over the radio wave marker transmission antenna 2 at high speed, the radio wave signal can be received at an early stage, so that it is possible to achieve an improvement in terms of detection reliability. Further, in Embodiment 6, the front portion of the metal cover broadens to secure a sufficient space, whereas the rear portion thereof is only spaced apart from the radio wave marker reception antenna 6 to a degree that it does not adversely affect the antenna characteristics. Thus, it is possible to reduce the influence of the noises from the rear, e.g., the engine ignition system noise and the noise emanated from a vehicle-mounted electronic apparatus such as a PC.

While in Embodiment 6 the metal cover 13 is used, this should not be construed restrictively. Any type of cover will do as long as it is formed of a conductive material.

Embodiment 7

Figure 7:
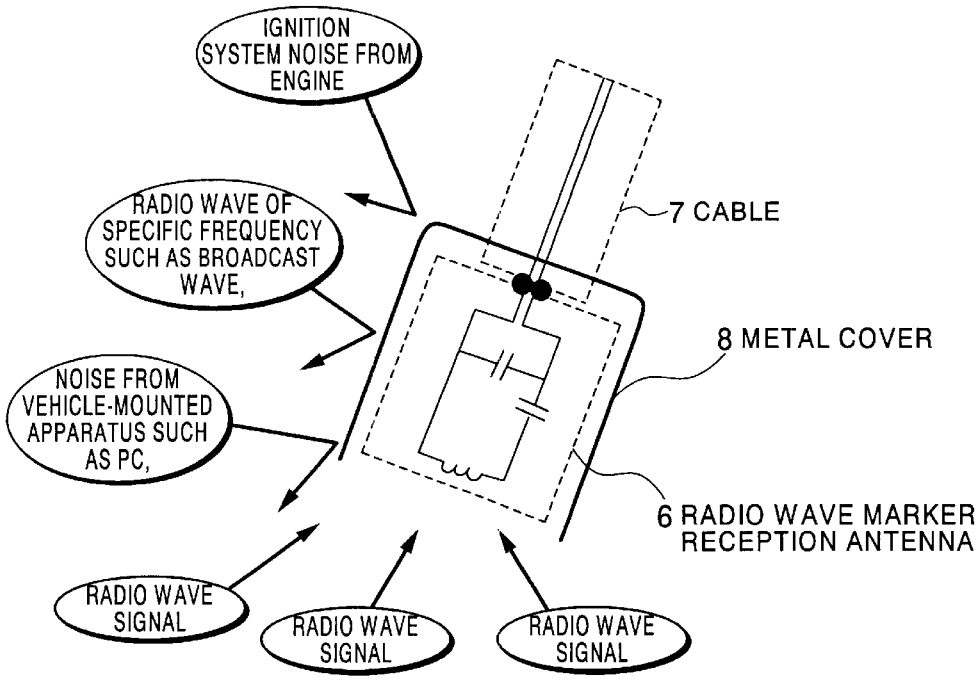
FIG. 7 is a schematic exterior view of a radio wave marker reception antenna according to Embodiment 7 of the present invention.

FIG. 7 is a schematic exterior view of a radio wave marker reception antenna according to Embodiment 7 of this invention, which differs from those of Embodiments 1 through 6.

In Embodiment 7, the same effect as that of Embodiment 6 is obtained by varying the angle at which the radio wave marker reception antenna 6 is fixed. The radio wave marker reception antenna 6 is inclined from the position where its lower side is oriented vertically downward to a position where its lower side is directed toward the direction of travel, whereby it is possible to receive the radio wave signal before the vehicle reaches the position directly above the road-side radio wave marker transmission antenna 2, thereby achieving an improvement in terms of detection performance. Thus, in the construction of Embodiment 7, even when the vehicle 3 passes over the radio wave marker transmission antenna 2 at high speed, the radio wave signal can be received at an early stage, whereby it is possible to achieve an improvement in detection reliability.

While in Embodiment 7 the metal cover 8 is used, this should not be construed restrictively. Any type of cover will do as long as it is formed of a conductive material.

Embodiment 8

Figure 8:
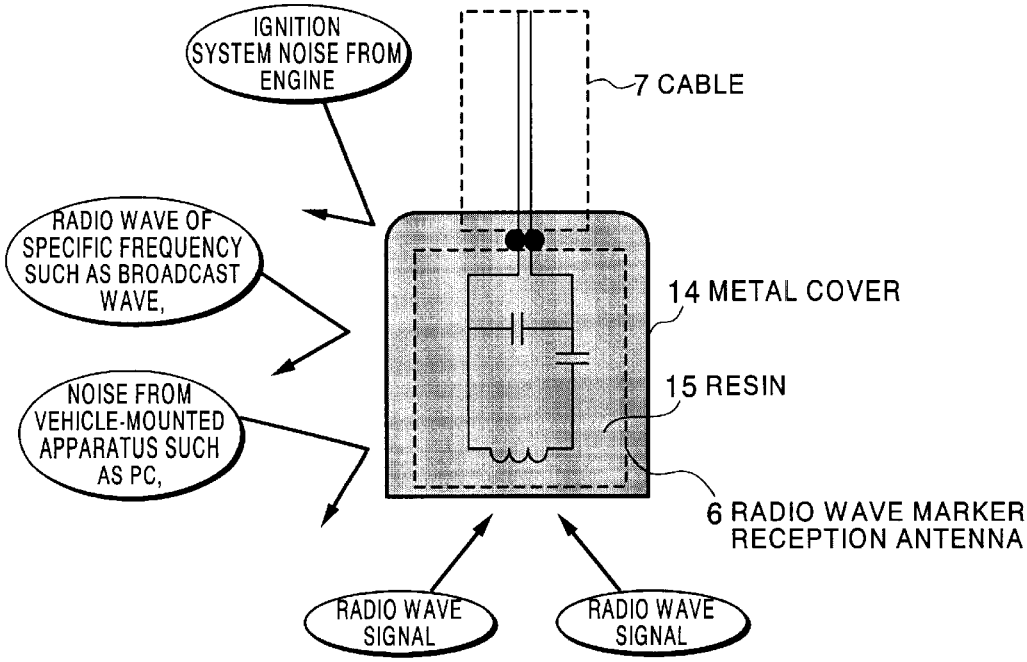
FIG. 8 is a schematic exterior view of a radio wave marker reception antenna according to Embodiment 8 of the present invention.
Figure 9:
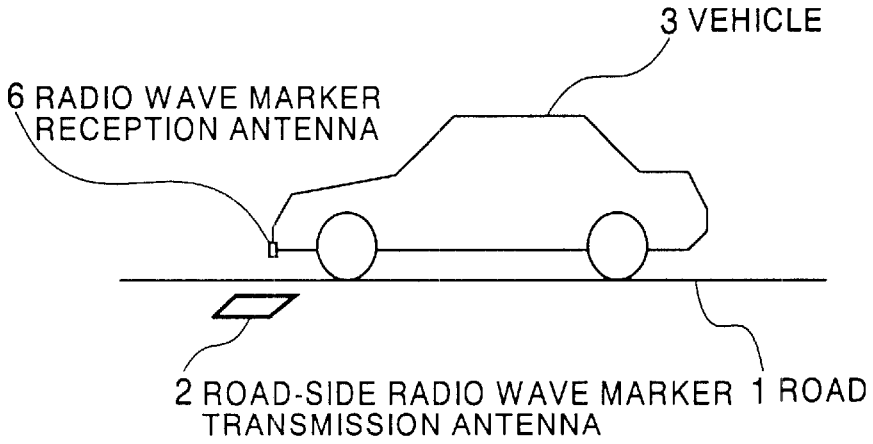
FIG. 9 is an overall schematic view of a conventional radio wave marker system.
Figure 10:
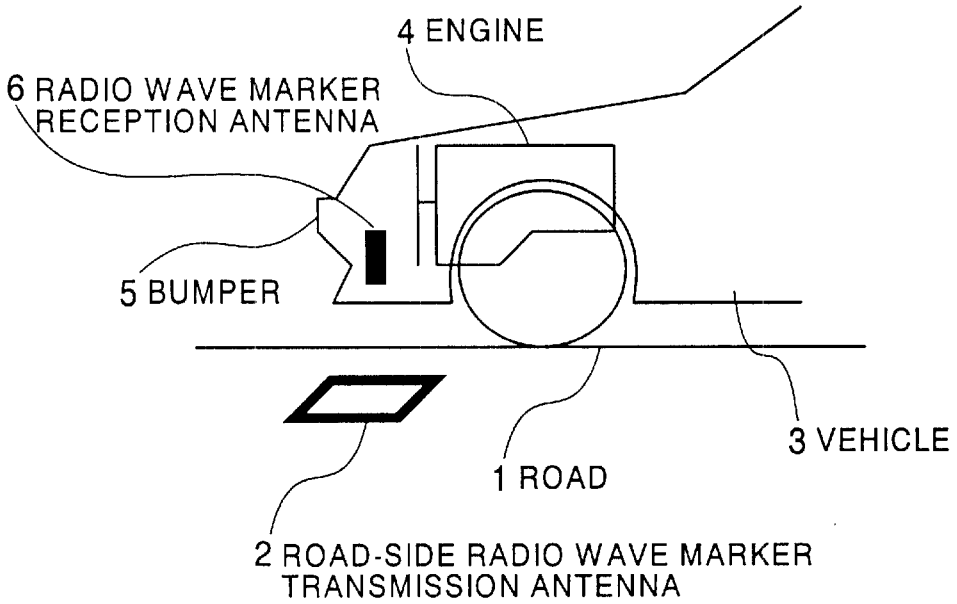
FIG. 10 is an overall schematic view of the conventional radio wave marker system.
Figure 11:
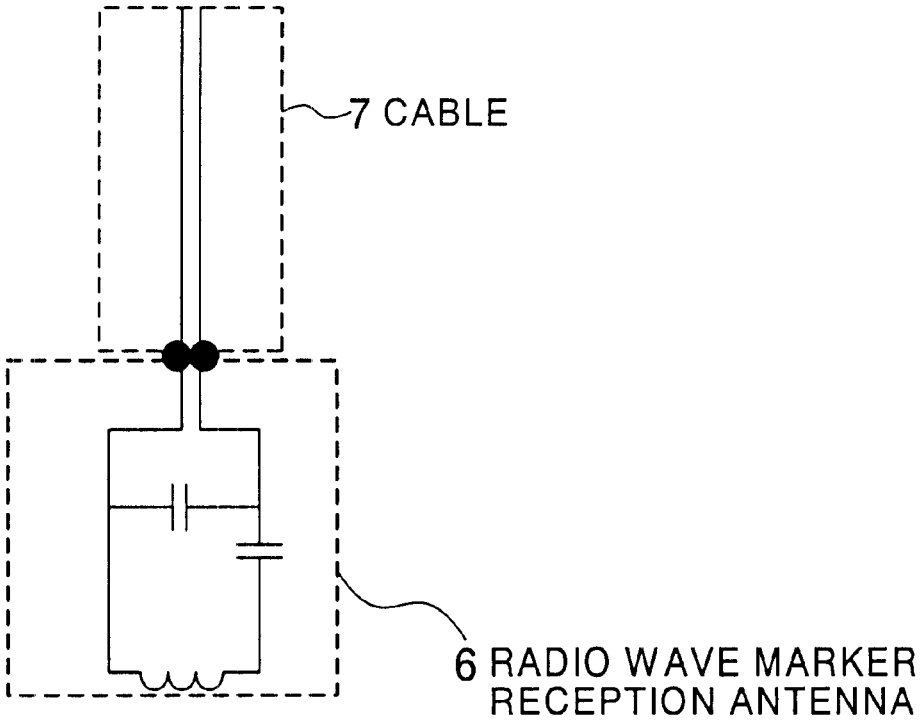
FIG. 11 is a schematic exterior view of the radio wave marker reception antenna in the conventional radio wave marker system.

FIG. 8 is a schematic exterior view of a radio wave marker reception antenna according to Embodiment 8 of this invention, which differs from those of Embodiments 1 through 7. In FIG. 8, numeral 14 indicates a metal cover, and numeral 15 indicates a resin with which the interior of the metal cover 14 is filled.

Even when the metal cover 14 is mounted such that enough space is secured around the radio wave marker reception antenna 6 so as not to affect the antenna characteristics of the radio wave marker reception antenna 6, the antenna characteristics of the radio wave marker reception antenna 6 can undergo a change if an impact is applied to the metal cover 14 at the time of collision or the like to cause deformation of the metal cover 14, which leads to a problem in the reception of the radio wave signal. In view of this, in Embodiment 8, the interior of the metal cover 14 is filled with the resin 15. Due to the presence of the resin 15, the metal cover 14 is not easily deformed, thereby making it possible to prevent the antenna characteristics from deteriorating.

While in Embodiment 8 the metal cover 14 is used, this should not be construed restrictively. Any type of cover will do as long as it is formed of a conductive material. Further, while in this embodiment the resin 15 is used, this should not be construed restrictively. Any material will do as long as it is a non-conductive material.

As described above, in accordance with this invention, the radio wave marker reception antenna is covered with a cover member formed of a conductive material, so that disturbance noises are reflected/absorbed by the conductive cover, whereby the reception of the radio wave signal from the road-side radio wave marker transmission antenna is facilitated.

By adopting a prism-shaped conductive cover, the machining can be conducted easily at low cost, and the mounting of the antenna to a planar portion is facilitated.

By adopting a cylindrical conductive cover, the machining can be conducted easily at low cost, and space saving can be achieved in performing the mounting.

By adopting a conical conductive cover, it is possible to lessen the influence of the cover on the antenna characteristics of the radio wave marker reception antenna.

By adopting a dome-shaped conductive cover, it is possible to concentrate the radio wave signal from the road-side radio wave marker transmission antenna on a focus inside the cover, thereby achieving an improvement in reception sensitivity.

By adopting a forwardly broadening conductive cover, it is possible to receive the radio wave signal from the road-side radio wave marker transmission antenna even before the vehicle reaches the position directly above the road-side radio wave transmission antenna, so that the radio wave signal can be received at an early stage even when the radio wave marker reception antenna passes over the road-side radio wave marker transmission antenna at high speed, thereby achieving an improvement in detection reliability.

By inclining the radio wave marker reception antenna from the position where its lower side is oriented vertically downward to a position where its lower side is directed obliquely toward the direction of travel and fixing it in this position, it is possible to detect the radio signal at an early stage even when the vehicle passes over the road-side radio wave marker transmission antenna at high speed, thereby achieving an improvement in detection reliability.

Further, by filling the interior of the conductive cover with a non-conductive material, it is possible to prevent deformation of the cover even when an impact or the like is applied thereto, thereby preventing a deterioration in the antenna characteristics of the radio wave marker reception antenna due to cover deformation.

What is claimed is:

1. A radio wave marker reception antenna mounted in a mobile body and adapted to receive driving assisting information from a road-side radio wave marker transmission antenna installed under the surface of a road, wherein the radio wave marker reception antenna is formed of a conductive material and equipped with a cover surrounding said antenna, said cover having an upper side and a lower side, wherein said lower side of said cover has an opening; and wherein said cover is formed of a conductive material.

2. A radio wave marker reception antenna according to claim 1, wherein the cover has a prism-shaped configuration.

3. A radio wave marker reception antenna according to claim 1, wherein the cover has a cylindrical configuration.

4. A radio wave marker reception antenna according to claim 1, wherein the cover has a conical configuration.

5. A radio wave marker reception antenna according to claim 1, wherein the cover has a dome-shaped configuration.

6. A radio wave marker reception. antenna according to claim 1, wherein the cover downwardly broadens in a fixed direction, and wherein the radio wave marker reception antenna is mounted in the mobile body such that said fixed direction is the direction of travel.

7. A radio wave marker reception antenna according to claim 1, wherein the cover is mounted in the mobile body and wherein said lower side of said cover is oriented toward a direction of travel of said mobile body.

8. A radio wave marker reception antenna according to claim 1, further comprising a means for preventing deformation of said cover and attendantly preventing deterioration of performance of said antenna, said means for preventing deformation comprising substantially filling said cover with a non-conductive material.

* * * * *